United States Patent [19]

Kennedy et al.

[11] Patent Number: 4,523,406

[45] Date of Patent: Jun. 18, 1985

[54] DOOR FRAME AND DOOR ASSEMBLY FOR A MINE STOPPING

[76] Inventors: John M. Kennedy; William R. Kennedy, both of P.O. Box 38, Taylorville, Ill. 62568

[21] Appl. No.: 513,747

[22] Filed: Jul. 15, 1983

[51] Int. Cl.[3] ..... E05D 15/58

[52] U.S. Cl. ..... 49/254; 49/55

[58] Field of Search ..... 49/55, 254

[56] References Cited

U.S. PATENT DOCUMENTS

| | | | |
|---|---|---|---|
| 597,145 | 1/1898 | Hartzell | 49/55 X |
| 1,024,441 | 4/1912 | Davis | 49/254 X |
| 2,153,798 | 4/1939 | Grimes | 49/55 X |
| 4,082,331 | 4/1978 | Kennedy et al. . | |
| 4,118,894 | 10/1978 | Kennedy et al. . | |

*Primary Examiner*—Kenneth Downey
*Attorney, Agent, or Firm*—Senniger, Powers, Leavitt and Roedell

[57] ABSTRACT

A door frame and door assembly for installation in a man-door opening in a mine stopping in which the door is hinged for swinging movement on an axis extending transversely across the frame adjacent one face of the frame and adjacent the top of the frame. The hinge also mounts the door for up and down movement of the door relative to the frame. The door is of such height as to occupy a closed position in the frame inclined down from the hinge toward the other face of the frame with its lower edge bearing on the bottom of the frame and with the door at its top being engageable with and extending up past the top of the frame at the one face of the frame. The door is adapted to swing up from its closed position for opening it, and to move relative to the frame at the hinge to avoid jamming and buckling of the door while maintaining closure of the door upon distortion of the frame such as may result from pressure on the frame in a mine stopping.

10 Claims, 5 Drawing Figures

DOOR FRAME AND DOOR ASSEMBLY FOR A MINE STOPPING

BACKGROUND OF THE INVENTION

This invention relates to doors for mine stoppings, and more particularly to so-called "man doors" for use in masonry and metal mine stoppings.

So-called "stoppings" are widely used in mines to stop off flow of air in passages in the mines, a "stopping" generally being a masonry (e.g., concrete block) or metal wall installed at the entrance of a passage to block flow of air therethrough. It is often desired that such stoppings be provided with a door, which is referred to as a "man door", for occasional access to the blocked-off passage. A serious problem is encountered, however, in providing a door for a stopping because heaving and shifting of the stopping, as often occurs, results in the parallelograming of the door frame, which may result in jamming and buckling of the door and leakage of air through the stopping.

This invention is in the same field as and may be regarded as representing an improvement upon the doors for a mine stopping disclosed in U.S. Pat. Nos. 4,082,331 and 4,118,894.

SUMMARY OF THE INVENTION

Among the several objects of this invention may be noted the provision of an improved door frame and door assembly for a mine stopping of such construction that even though the frame may become distorted due to shifting of the stopping, the door will not become jammed and remains capable of being readily opened for access to the blocked-off passage even after such shifting; the provision of such an assembly in which the door is adapted generally to keep the man-door opening closed; and the provision of such an assembly which, while being effective for its purpose, is of simple and economical construction.

In general, a door frame and door assembly of this invention comprises a rectangular frame having a top, bottom and sides, a door, and hinge means for the door. The hinge means mounts the door for swinging movement on an axis extending transversely across the frame adjacent one face of the frame and adjacent the top of the frame. It also mounts the door for up and down movement of the door relative to the frame. The door is of such height as to occupy a closed position in the frame inclined down from the hinge means toward the other face of the frame with its lower edge bearing on the bottom of the frame and with the door at its top being engageable with and extending up past the top of the frame at the one face of the frame. The door is adapted to swing up from its closed position for opening it, and is adapted to shift up relative to the frame upon distortion of the frame such as may result from pressure on the frame in a mine stopping in a mine.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
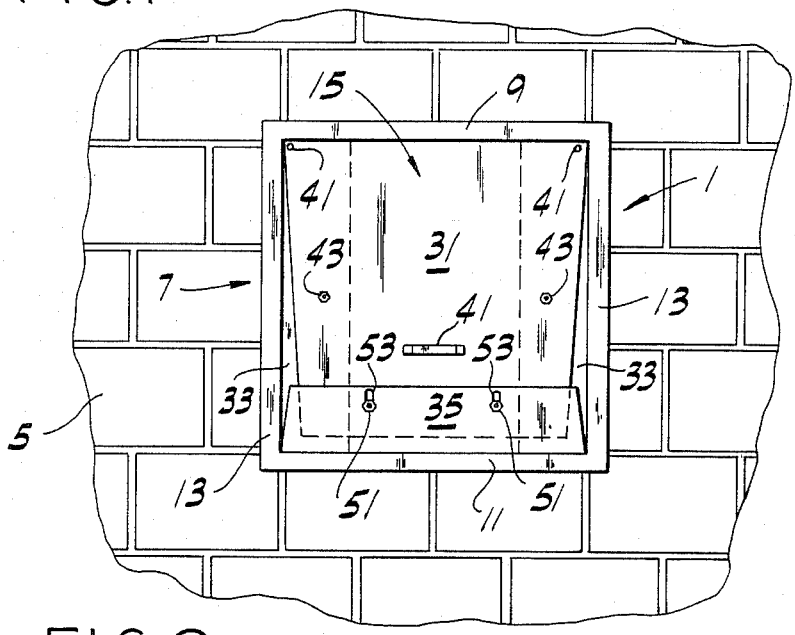
FIG. 1 is a front elevation of a mine stopping having a door frame and door assembly of this invention installed therein.

Referring to the drawings, there is generally indicated at 1 a door frame and door assembly of this invention installed in a man-door opening indicated at 3 in a masonry mine stopping 5, e.g. a concrete block mine stopping, the latter typically being built up at the entrance of a no longer used passage in a mine to block the flow of air through the passage. The assembly comprises a rectangular frame 7 having a top 9, bottom 11 and left and right sides each designated 13, a door 15, and hinge means indicated at 17. Typically, the frame is generally square, measuring about 32 inches (81.28 cm) wide and 32 inches (81.28 cm) high inside dimensions, for example. The frame 7 is in effect mounted in the man-door opening 3 in the stopping 5 with the bottom or sill 11 of the frame bearing on the stopping at the bottom of the man-door opening 3, the sides 13 of the frame extending up at opposite sides of the opening 3, and the top 9 of the frame forming a lintel at the top of the opening 3.

As illustrated, the top 9 of the frame 7 is constituted by a metal channel member with a width W1 between its upwardly extending forward and rearward flanges 19 and 21, respectively, slightly greater than the thickness of the concrete blocks of which the stopping is built. Its web is designated 23.

The bottom 11 of the frame 7 comprises a metal channel member with a width W1, the same as the width of the top channel member 9, between its downwardly extending forward and rearward flanges 25 and 27, respectively, slightly greater than the thickness of the concrete blocks of which the stopping is built. The web of the bottom channel member is designated 29.

Each side 13 of the frame 7 is of channel shape in cross section (not shown) similar to the top and bottom metal channel members 9 and 11, respectively, with flanges extending laterally outwardly away from the door.

Figure 2:
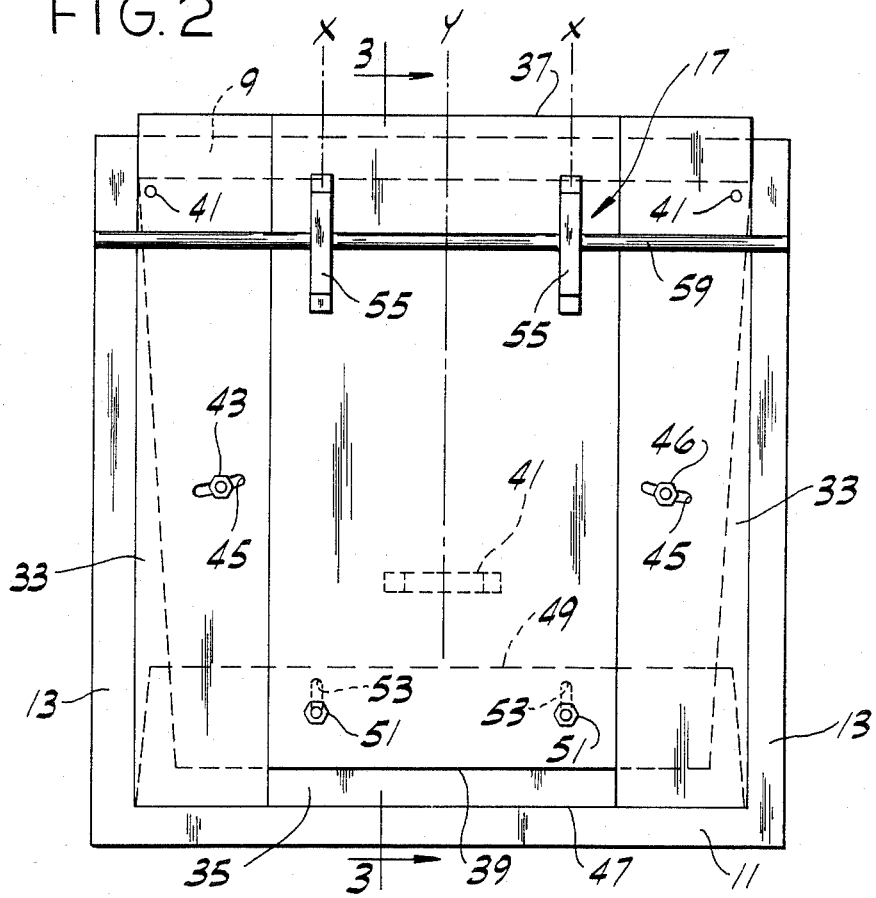
FIG. 2 is an enlarged rear elevation of the door frame and door assembly of FIG. 1.

The door 15 comprises a main door panel 31, side panels 33 and a bottom panel 35. The main door panel 31, as seen in FIGS. 1 and 2, is trapezoidal in shape with its upper edge 37 longer than its lower edge 39. The upper edge 37 of the main door panel 31 has a length generally equal to the width of the frame 7. The height of the main door panel 31 is greater than the height of th.e frame 7 for reasons which will become apparent later. A handle 41 is suitably secured to the front face of the main door panel 31. The side panels 33 are generally rectangular in shape and slightly longer than the height of the main door panel 31. They are pivotally attached at their upper outer corners to the rear face of the main door panel 31 at the upper corners of the panel by pins 41 for swinging movement on axes at right angles to the plane of the panel 31 at the upper corners of the panel 31. The latter has bolts 43 extending through arcuate slots 45 in the side panels 33, nuts 46 being threaded on the bolts on the outside of the side panels adapted to be tightened on the bolts to maintain the side panels 33 in various positions of angular adjustment relative to the panel 31 within the range permitted by the slots 45, which is sufficient to accommodate for all except unusual parallelogramming of the frame 7.

The bottom panel 35 is trapezoidal in shape with its lower edge 47 longer than its upper edge 49 and corresponding generally to the inside width of the frame 7. The bottom panel 35 is secured to the main door panel 31 on the front face of the latter and extending down below the latter by means of nut and bolt fasteners such as indicated at 51, the bolts of which extend from panel 31 loosely through slots 53 in the panel 35, whereby the panel may be shifted to various positions of angular adjustment relative to the panel 31 within the range permitted by the slots 53, which is sufficient to accommodate for all except unusual parallelogramming of the frame 7.

The hinge means 17 for the door comprises a pair of generally C-shaped hinge members each designated 55 secured as by welding on the back of the main door panel 31 adjacent the top of this panel and in vertical planes X on opposite sides of the vertical center line Y of the door (see FIG. 2) inside the side panels 33, and a rod 59 extending transversely of the frame 7 across its rear face and across the back of the door 15 through the C-shaped members. The latter are of such height as to allow for up and down shifting of the door 15 relative to the rod 59 in the inclined plane of the door, within a range such as to accommodate for all except unusual relative shifting of the top and bottom of the frame 7. The rod 59 is suitably secured at its ends to the back of the sides 13 of the frame, as by welding.

Figure 3:
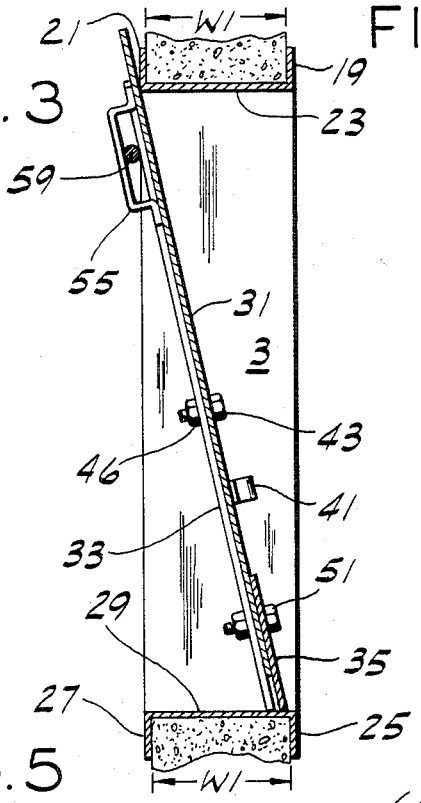
FIG. 3 is a vertical section on line 3—3 of FIG. 2.

As illustrated in FIGS. 1–3, the frame 7 is in its as-installed rectangular configuration. The door 15 (comprising main panel 31, side panels 33 and bottom panel 35) occupies a closed position generally completely closing the opening 3 in the frame inclined down from the rod 59 of the hinge means 17 toward the front face of the frame 7 with its lower edge, i.e., the lower edge of the bottom panel 35, bearing on the web 29 of the bottom 11 of the frame and extending up from the rod 59 beyond the top 9 of the frame at the rear face of the frame. The outer edges of the side panels 33 are contiguous to the inside of the webs of the sides 13 of the frame to close the opening 3 at the sides. Opening 3 is closed at the bottom by engagement of the lower edge of the bottom panel 35 with the bottom 11 of the frame, and at the top by engagement or near engagement of the front face of the main door panel 31 with the top frame member 9 at its rear.

Figure 4:
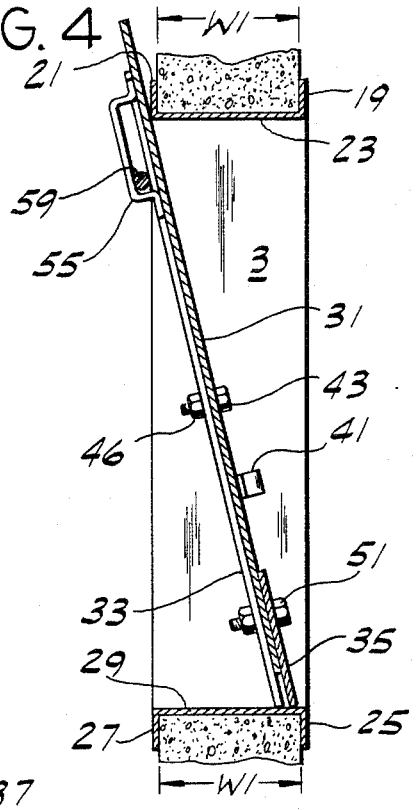
FIG. 4 is a view similar to FIG. 3 showing the frame distorted and the door in a shifted position.
Figure 5:
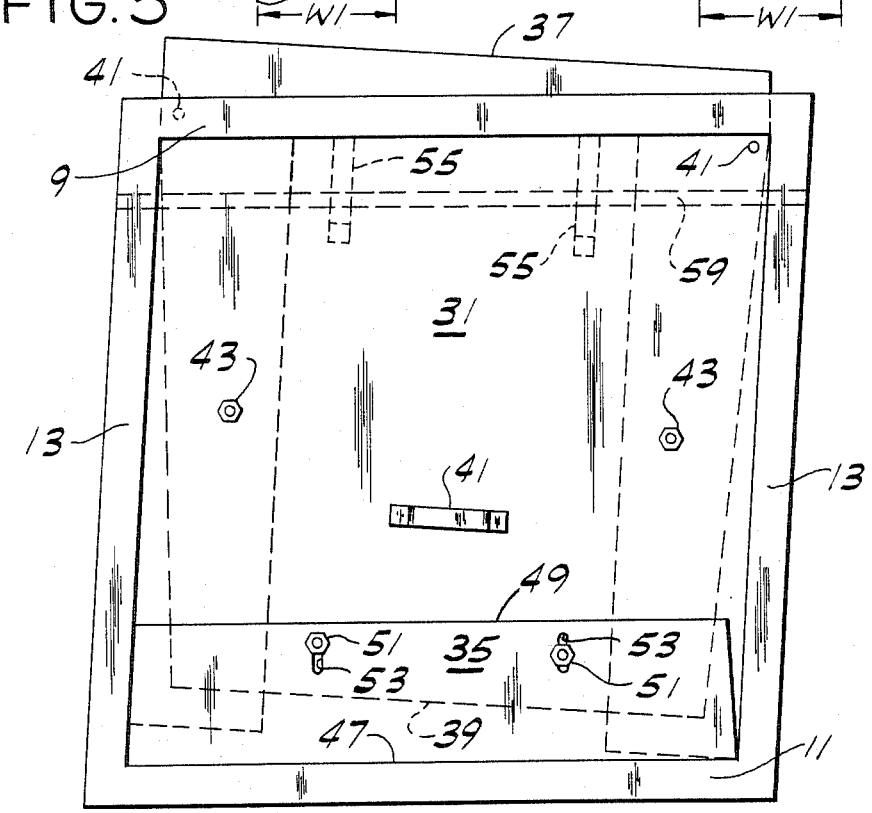
FIG. 5 a rear elevation of FIG. 4.

FIGS. 4 and 5 illustrate the frame 7 in a typical parallelogrammed condition wherein the top and bottom 9 and 11, respectively, of the frame are shifted closer to one another and the top 9 is shifted to the right relative to the bottom 11, as a result of shifting of the mine stopping 5 due to heaving, and illustrate how jamming and buckling of the door 15 is avoided, and how the door may be adjusted for relatively complete closure of the opening 3 despite the distortion of the frame 7 to the shape of a parallelogram. Jamming and buckling of the door 15 vertically are avoided due to the door (as a whole) shifting upward on the rod 59 relative to the frame 7 in the inclined plane of the door, the door 15 being relatively free to slide upward (within the limits of the hinge connections) behind the top frame member 9 under the relatively upward force to which it is subjected by engagement of the bottom frame member 11 and the lower edge of the bottom door panel 35. Jamming and buckling of the door horizontally are avoided due to the right side panel 33 being swung clockwise on its pivot at 41 from its normal FIG. 2 position. Contact is maintained between the right side edge of the right side panel 33 and the right side frame member 13 so that opening 3 remains closed at the right. The bottom panel 35 may be shifted for engagement of its lower edge 47 generally throughout the length of this edge with the bottom frame member 11 for closing the opening 3 at the bottom, and maintained in position as so adjusted by tightening the nuts of the fasteners 51. The left side panel 33 may be swung about its pivot at 41 for engagement of its left edge with the left side frame member 13 for closing the opening at the left side and maintained in position as so adjusted by tightening the nuts 46 on bolts 43.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A door frame and door assembly for installation in a man-door opening in a mine stopping, said assembly comprising a rectangular frame having a top, bottom and sides, a door, and hinge means for the door, the hinge means mounting the door for swinging movement on an axis extending transversely across the frame adjacent one face of the frame and adjacent the top of the frame, the hinge means also mounting the door for up and down movement of the door relative to the frame, the door being of such height as to occupy a closed position in the frame inclined down from the hinge means toward the other face of the frame with its lower edge bearing on the bottom of the frame and with the door at its top being engagable with and extending up past the top of the frame at said one face of the frame, the door being adapted to swing up from its said closed position for opening it, and being adapted to shift up relative to the frame upon distortion of the frame such as may result from pressure on the frame in a mine stopping in a mine.

2. A door frame and door assembly as set forth in claim 1 wherein said hinge means mounts the door for sliding movement in its own plane relative to the frame.

3. A door frame and door assembly as set forth in claim 2 wherein the hinge means comprises a plurality of generally C-shaped hinge members secured to one face of the door and a rod extending transversely across the one face of the frame and through the C-shaped members.

4. A door frame and door assembly as set forth in claim 1 wherein the door comprises a main door panel, side panels, and means mounting said side panels on one face of said main door panel for movement of said side panels laterally relative to said main door panel for maintaining closure of the door upon distortion of the frame.

5. A door frame and door assembly for installation in a man-door opening in a mine stopping, said assembly comprising a rectangular frame having a top, bottom and sides, a door, and hinge means for the door, the hinge means mounting the door for swinging movement on an axis extending transversely across the frame adjacent one face of the frame and adjacent the top of the frame, the hinge means also mounting the door for up and down movement of the door relative to the frame, the door being of such height as to occupy a closed position in the frame inclined down from the hinge means toward the other face of the frame with its lower edge bearing on the bottom of the frame and with the door at its top being engagable with and extending up past the top of the frame at said one face of the frame, the door being adapted to swing up from its said closed position for opening it, and being adapted to shift up relative to the frame upon distortion of the frame such as may result from pressure on the frame in a mine stopping in a mine, said door comprising a main door panel, said panels, and means mounting said side panels on one face of said main door panel for movement of said side panels laterally relative to said main door panel for maintaining closure of the door upon distortion of the frame, said side panel mounting means mounting said side panels for pivotal movement on the rear face of the main door panel.

6. A door frame and door assembly as set forth in claim 5 wherein said main door panel is trapezoidal in shape with its upper edge longer than its lower edge.

7. A door frame and door assembly as set forth in claim 5 wherein the door further comprises a bottom panel and means for mounting said bottom panel on said main door panel for shifting of said bottom panel relative to said main door panel to maintain closure of the door upon distortion of the frame by having the bottom edge of said bottom panel bear on the bottom of the frame.

8. A door frame and door assembly as set forth in claim 7 wherein the bottom panel is trapezoidal in shape with its lower edge longer than its upper edge.

9. A door frame and door assembly as set forth in claim 7 wherein said bottom panel mounting means mounts it for sliding movement on the front face of the main door panel.

10. A door frame and door assembly as set forth in claim 1 wherein the door comprises a main door panel, a bottom panel, and means mounting said bottom panel on a face of said main door panel for shifting of said bottom panel relative to said main door panel to maintain closure of the door upon distortion of the frame by having the bottom edge of said bottom panel bear on the bottom of the frame.

* * * * *